US008449277B2

(12) United States Patent
Sakakibara et al.

(10) Patent No.: US 8,449,277 B2
(45) Date of Patent: May 28, 2013

(54) VANE PUMP HAVING A PASSAGE AREA RATIO BETWEEN AN OIL SUPPLY PASSAGE AREA AND A GAS PASSAGE AREA

(75) Inventors: Ryuichi Sakakibara, Toyota (JP); Kikuji Hayashida, Toyota (JP); Kiyotaka Ohtahara, Toyota (JP); Yoshimasa Kuno, Toyota (JP)

(73) Assignee: Taiho Kogyo Co., Ltd., Toyota-shi, Aichi (JP)

( * ) Notice: Subject to any disclaimer, the term of this patent is extended or adjusted under 35 U.S.C. 154(b) by 67 days.

(21) Appl. No.: 13/138,400

(22) PCT Filed: Nov. 17, 2010

(86) PCT No.: PCT/JP2010/070444

§ 371 (c)(1),
(2), (4) Date: Aug. 10, 2011

(87) PCT Pub. No.: WO2011/135747

PCT Pub. Date: Nov. 3, 2011

(65) Prior Publication Data

US 2012/0156076 A1 Jun. 21, 2012

(30) Foreign Application Priority Data

Apr. 27, 2010 (JP) ..... 2010-102249

(51) Int. Cl.
*F03C 4/00* (2006.01)
*F04C 15/00* (2006.01)
*F04C 2/00* (2006.01)
*F04C 27/02* (2006.01)

(52) U.S. Cl.
USPC ..... 418/94; 418/98; 418/188; 418/255

(58) Field of Classification Search
USPC ..... 418/93–94, 96–100, 106, 150, 188, 418/253–255, 259, 266–268
See application file for complete search history.

(56) References Cited

U.S. PATENT DOCUMENTS

| | | | | |
|---|---|---|---|---|
| 7,588,433 | B2 * | 9/2009 | Kishi et al. | 418/255 |
| 7,628,595 | B2 * | 12/2009 | Ono et al. | 418/255 |
| 7,896,631 | B2 * | 3/2011 | Kishi et al. | 418/255 |

FOREIGN PATENT DOCUMENTS

| | | | |
|---|---|---|---|
| JP | 2006118424 A | * | 5/2006 |
| JP | 2006-226164 | | 8/2006 |
| JP | 2006226165 A | * | 8/2006 |
| JP | 2006226166 A | * | 8/2006 |
| JP | 2009-185699 | | 8/2009 |

* cited by examiner

*Primary Examiner* — Theresa Trieu
(74) *Attorney, Agent, or Firm* — Flynn, Thiel, Boutell & Tanis, P.C.

(57) ABSTRACT

A vane pump in which a lubricating oil from an oil supply pipe 12 is supplied to a pump chamber 2A through an axial direction oil supply hole 11*a* of an oil supply passage 11, a diameter direction oil supply hole 11*b*, and an axial direction oil supply groove 11*c*. A gas passage 13 includes a diameter direction gas hole 13*a* and an axial direction gas groove 13*b*, and the diameter direction gas hole 13*a* is made to communicate with the axial direction gas groove 13*b* when the diameter direction oil supply hole 11*b* is made to communicate with the axial direction oil supply groove 11*c*.

4 Claims, 3 Drawing Sheets

VANE PUMP HAVING A PASSAGE AREA RATIO BETWEEN AN OIL SUPPLY PASSAGE AREA AND A GAS PASSAGE AREA

TECHNICAL FIELD

The present invention relates to a vane pump and, more particularly, to a vane pump in which an oil supply passage through which a lubricating oil flows is formed inside a rotor, and in which the lubricating oil is intermittently supplied in a pump chamber by a rotation of the rotor.

BACKGROUND ART

Conventionally, a vane pump has been known, which includes: a housing including a substantially circular pump chamber; a rotor that rotates about a position eccentric with respect to a center of the pump chamber; a vane that is rotated by the rotor and that always partitions the pump chamber into a plurality of spaces; an oil supply passage that intermittently communicates with the pump chamber by the rotation of the rotor; an oil supply pipe that is connected to this oil supply passage to supply a lubricating oil from a hydraulic pump thereto; and a gas passage that makes the pump chamber and an outer space communicate with each other when the oil supply passage communicates with the pump chamber by the rotation of the rotor, wherein the oil supply passage includes: a diameter direction oil supply hole provided at a shaft part of the rotor in a diameter direction thereof; and an axial direction oil supply groove that is provided in the housing to communicate with the pump chamber, and with which an opening of the diameter direction oil supply hole is made to intermittently overlappingly communicate by the rotation of the rotor, and wherein the gas passage includes: a diameter direction gas hole that is provided at the shaft part of the rotor in the diameter direction thereof to communicate with the oil supply passage; and an axial direction gas groove that is provided in the housing to communicate with the outer space, and with which an opening of the diameter direction gas hole is made to intermittently overlappingly communicate by the rotation of the rotor, and wherein the diameter direction gas hole is made to communicate with the axial direction gas groove when the diameter direction oil supply hole is made to communicate with the axial direction oil supply groove. (Patent Document 1)

In the above-described vane pump, when the rotor stops in a state where the diameter direction oil supply hole of the oil supply passage is in communication with the axial direction oil supply groove, the lubricating oil inside the oil supply passage is drawn into the pump chamber by a negative pressure thereinside. If a large amount of lubricating oil is then drawn into the pump chamber, an excessive load is added to the vanes when the vane pump is subsequently started in order to discharge the lubricating oil, which may cause a damage to the vane.

However, in the vane pump having the above-described configuration, when the rotor stops in the state where the diameter direction oil supply hole of the oil supply passage is in communication with the axial direction oil supply groove, the diameter direction gas hole of the gas passage is adapted to communicate with the axial direction gas groove at the same time, so as to allow the air of the outer space to flow into the pump chamber through the gas passage. Hence, since the negative pressure in the pump chamber can be eliminated by allowing the air of the outer space to flow into the pump chamber, a large amount of lubricating oil can be prevented from entering the pump chamber.

PRIOR ART DOCUMENTS

Patent Document 1: Japanese Patent Laid-Open No. 2006-226164

SUMMARY OF INVENTION

Problems to be Solved by the Invention

However, in the above-described vane pump, it turned out that when a hydraulic pressure of the lubricating oil supplied from the hydraulic pump to the oil supply passage was low such as at the time of engine idling, the air of the outer space was sucked into the pump chamber from the gas passage, and thereby engine driving torque was increased.

In view of such conditions, the present invention provides a vane pump in which even though a hydraulic pressure of a lubricating oil supplied from a hydraulic pump to an oil supply passage is low, the air is prevented from being sucked into a pump chamber from a gas passage as much as possible, and thereby engine driving torque can be prevented from increasing.

Means for Solving the Problems

Namely, the present invention is a vane pump including: a housing including a substantially circular pump chamber; a rotor that rotates about a position eccentric with respect to a center of the pump chamber; a vane that is rotated by the rotor and that always partitions the pump chamber into a plurality of spaces; an oil supply passage that intermittently communicates with the pump chamber by the rotation of the rotor; an oil supply pipe that is connected to this oil supply passage to supply a lubricating oil from a hydraulic pump thereto; and a gas passage that makes the pump chamber and an outer space communicate with each other when the oil supply passage communicates with the pump chamber by the rotation of the rotor, wherein the oil supply passage includes: a diameter direction oil supply hole provided at a shaft part of the rotor in a diameter direction thereof; and an axial direction oil supply groove that is provided in the housing to communicate with the pump chamber, and with which an opening of the diameter direction oil supply hole is made to intermittently overlappingly communicate by the rotation of the rotor, and wherein the gas passage includes: a diameter direction gas hole that is provided at the shaft part of the rotor in the diameter direction thereof to communicate with the oil supply passage; an axial direction gas groove that is provided in the housing to communicate with the outer space, and with which an opening of the diameter direction gas hole is made to intermittently overlappingly communicate by the rotation of the rotor, and wherein the diameter direction gas hole is made to communicate with the axial direction gas groove when the diameter direction oil supply hole is made to communicate with the axial direction oil supply groove, and the vane pump is characterized in that when a passage area of the gas passage is defined as $S_1$, a passage area of the oil supply passage is $S_2$, a passage area of the oil supply pipe is $S_3$, a diameter of the diameter direction oil supply hole is $d_2$, and a width of the axial direction oil supply groove in a rotational direction of the rotor is L, the passage area $S_2$ of the oil supply passage is set to be in a range of $S_1<S_2\leqq 3\times S_1$, and the passage area $S_3$ of the oil supply pipe is set to be in a range of $S_2<S_3\leqq 3\times S_2$, and further the width L of the axial direction oil supply groove is set to be in a range of $d_2<L<4\times d_2$.

Advantageous Effects of Invention

Generally, the passage area $S_1$ of the gas passage is set to be as small a passage area $S_1$ as possible in order to reduce the leakage of the lubricating oil to the outer space through the gas passage, i.e., to an internal space of an engine, when the hydraulic pressure of the lubricating oil supplied from the hydraulic pump to the oil supply passage is high.

On the other hand, conventionally, particular attention has not been paid to size relations of the above-described passage area $S_2$ of the oil supply passage, passage area $S_3$ of the oil supply pipe, diameter $d_2$ of the diameter direction oil supply hole, and width L of the oil supply groove in the rotational direction of the rotor from a viewpoint that it is only necessary to supply a required lubricating oil to the pump chamber.

However, in the present invention, in order to prevent the air of the outer space from being sucked into the pump chamber from the gas passage as much as possible when the hydraulic pressure of the lubricating oil supplied from the hydraulic pump to the oil supply passage is low, the passage area $S_2$ of the oil supply passage is set to be in the range of $S_1<S_2\leqq 3\times S_1$. Namely, the passage area $S_2$ of the oil supply passage is set to be a relatively small passage area that is at most three times larger than the passage area $S_1$ that is as small as possible of the gas passage to thereby make the air difficult to be sucked. It is to be noted that the passage area $S_2$ of the oil supply passage disclosed in FIG. 3 of the above-described Patent Document 1 is set to be approximately sixteen times as large as the passage area $S_1$ of the gas passage, which is a comparison based on a drawing.

On the other hand, the passage area $S_2$ of the oil supply passage is set to be larger than the passage area $S_1$ of the gas passage, so that the required lubricating oil is reliably supplied in the pump chamber during operation beyond idling of the vane pump.

Next, in the present invention, the passage area $S_3$ of the oil supply pipe is set to be in the range of $S_2<S_3\leqq 3\times S_2$ with respect to the passage area $S_2$ of the oil supply passage set to be relatively small. This is because a squeezing effect can be obtained by making the passage area $S_3$ of the oil supply pipe larger than the passage area $S_2$ of the oil supply passage, and thereby a hydraulic pressure in the oil supply passage can be kept as high as possible even with a small amount of lubricating oil at the time of idling.

Further, in the present invention, the width L of the axial direction oil supply groove is set to be in the range of $d_2<L<4\times d_2$. The opening of the diameter direction oil supply hole intermittently crosses the axial direction oil supply groove by the rotation of the rotor, and when crossing it, the opening is overlapped to be in communication with the groove. However, when the width L of the axial direction oil supply groove is set to be too large, a time of communication, i.e., an overlap time, becomes longer, and particularly when the hydraulic pressure of the oil supply passage at the time of idling is low, the air is easily sucked due to vacuum of the pump chamber.

From such a viewpoint, the width L of the axial direction oil supply groove is set to be in the above-described range to thereby suppress suck of the air.

MODE FOR CARRYING OUT THE INVENTION

Figure 1:
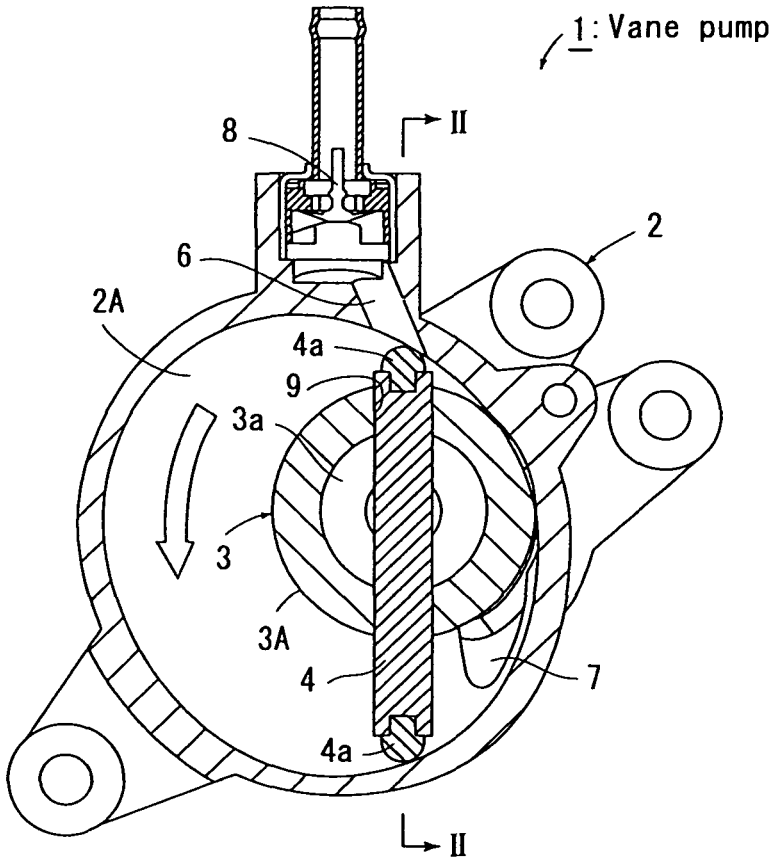
FIG. 1 is an elevational view of a vane pump showing an embodiment of the present invention.
Figure 2:
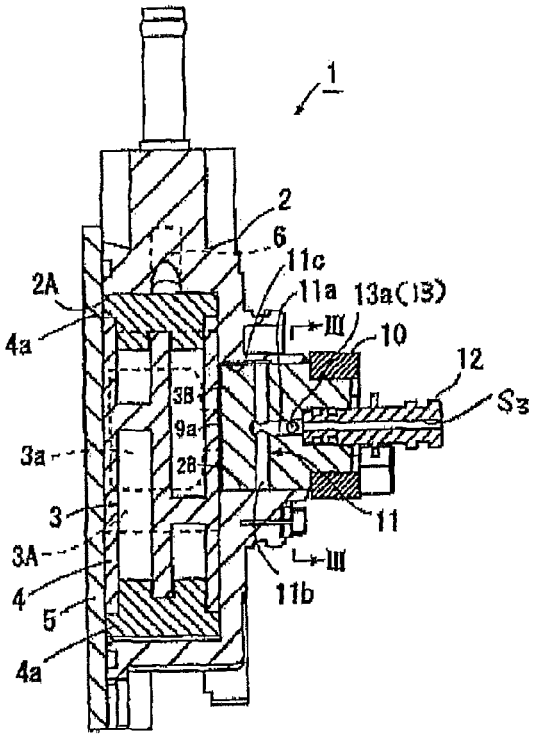
FIG. 2 is a cross-sectional view taken along a line II-II in FIG. 1.

Hereinafter, when describing an embodiment shown in drawings of the present invention, FIGS. 1 and 2 show a vane pump 1 according to the present invention, and this vane pump 1 is fixed to a side surface of an engine of an automobile, which is not shown, to generate a negative pressure in a servo unit for a brake system, which is not shown.

This vane pump 1 includes: a housing 2 in which a substantially circular pump chamber 2A is formed; a rotor 3 that is rotated by an engine drive force about a position eccentric with respect to a center of the pump chamber 2A; a vane 4 that is rotated by the rotor 3 and that always partitions the pump chamber 2A into a plurality of spaces; and a cover 5 that closes the pump chamber 2A.

The housing 2 is provided with an intake air passage 6 that communicates with the servo unit for the brake to suck a gas from the servo unit, the intake air passage 6 being located at an upper part of the pump chamber 2A, and a discharge passage 7 for discharging the gas sucked from the servo unit, the discharge passage 7 being located at a lower part of the pump chamber 2A, respectively. Additionally, the intake air passage 6 is provided with a check valve 8 in order to hold a negative pressure in the servo unit particularly when the engine is stopped.

The rotor 3 includes a cylindrical rotor part 3A that rotates in the pump chamber 2A, an outer periphery of the rotor part 3A is provided so as to contact with an inner peripheral surface of the pump chamber 2A, the intake air passage 6 is located at an upstream side with respect to a rotation of the rotor part 3A, and the discharge passage 7 is formed closer to a downstream side than the rotor part 3A.

In addition, a groove 9 is formed in a diameter direction at the rotor part 3A, and the vane 4 is slidably moved in a direction perpendicular to an axial direction of the rotor 3 along the groove 9. Additionally, a lubricating oil from an oil supply passage, which will be described hereinafter, flows between a hollow part 3*a* formed in a center of the rotor part 3A and the vane 4.

Further, caps 4*a* are provided at both ends of the vane 4, and the pump chamber 2A is always partitioned into two or three spaces by rotating these caps 4*a* while always sliding them on the inner peripheral surface of the pump chamber 2A.

Specifically, the pump chamber 2A is partitioned by the vane 4 into an illustrated horizontal direction in a state of FIG. 1, further, the pump chamber is partitioned by the rotor part 3A into a vertical direction in a space of an illustrated right side, and therefore, the pump chamber 2A is partitioned into a total of three spaces.

When the vane 4 rotates to the vicinity of a position connecting the center of the pump chamber 2A and a rotation center of the rotor 3 by the rotation of the rotor 3 from this state of FIG. 1, the pump chamber 2A is partitioned into two spaces: a space of an intake air passage 6 side; and a space of a discharge passage 7 side.

FIG. 2 shows a cross-sectional view of a II-II part in the above-described FIG. 1, a bearing part 2B for pivotally supporting a shaft part 3B constituting the rotor 3 is formed at an illustrated right side of the pump chamber 2A in the housing 2, and the shaft part 3B rotates integrally with the rotor part 3A.

In addition, the cover 5 is provided at a left end of the pump chamber 2A, the rotor part 3A and an end surface of an illustrated left side of the vane 4 rotate slidingly contacting with this cover 5, and additionally, an end surface of a right side of the vane 4 rotates slidingly contacting with an inner surface of a bearing part 2B side of the pump chamber 2A.

In addition, a bottom surface 9*a* of the groove 9 formed in the rotor 3 is formed slightly closer to a shaft part 3B side than the surface with which the pump chamber 2A and the vane 4 slidingly contact, and a gap is formed between the vane 4 and the bottom surface 9*a*.

Further, the shaft part 3B projects to the illustrated right side more than the bearing part 2B of the housing 2, couplings 10 rotated by an engine cam shaft are coupled at this projecting position, and the rotor 3 is rotated by a rotation of the cam shaft.

Additionally, an oil supply passage 11 through which the lubricating oil is flowed is formed at the shaft part 3B, and this oil supply passage 11 is connected to a hydraulic pump driven by an engine, which is not shown, through an oil supply pipe 12.

The oil supply passage 11 includes: an axial direction oil supply hole 11*a* formed in an axial direction of the shaft part 3B; and a diameter direction oil supply hole 11*b* perforated in a diameter direction of the shaft part 3B, the hole 11*b* communicating with this axial direction oil supply hole 11*a*.

In addition, at the bearing part 2B of the housing 2, formed is an axial direction oil supply groove 11*c* constituting the oil supply passage 11 formed so as to make the pump chamber 2A and the diameter direction oil supply hole 11*b* communicate with a sliding part with the shaft part 3B, and the axial direction oil supply groove 11*c* is formed at an upper part of the bearing part 2B shown in FIG. 2 in the embodiment.

According to this configuration, when an opening of the diameter direction oil supply hole 11*b* overlaps and communicates with the axial direction oil supply groove 11*c* as shown in FIG. 2, the lubricating oil from the axial direction oil supply hole 11*a* flows into the pump chamber 2A through the diameter direction oil supply hole 11*b* and the axial direction oil supply groove 11*c*, and then flows into the hollow part 3*a* of the rotor 3 from the gap between the vane 4 and the bottom surface of the groove 9.

Additionally, the vane pump 1 of the embodiment includes a gas passage 13 that makes the pump chamber 2A communicate with an outer space when the oil supply passage 11 is made to communicate with the pump chamber 2A by the rotation of the rotor 3, and more specifically, when the opening of the diameter direction oil supply hole 11*b* overlaps the axial direction oil supply groove 11*c*.

The gas passage 13 includes a diameter direction gas hole 13*a* perforated in the shaft part 3B by penetrating the axial direction oil supply hole 11*a* constituting the oil supply passage 11, and this diameter direction gas hole 13*a* is formed at a place displaced from the diameter direction oil supply hole 11*b* of the oil supply passage 11 by 90 degrees.

Figure 3:
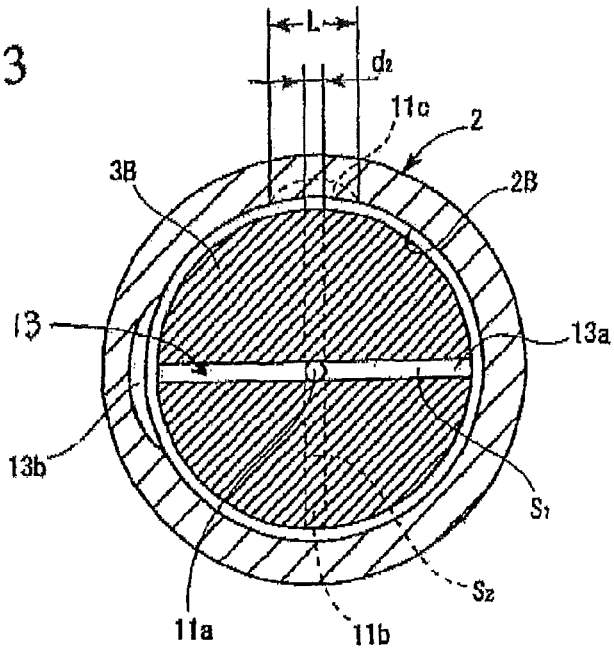
FIG. 3 is a cross-sectional view taken along a line in FIG. 2.

Further, when a cross-sectional view in a part of FIG. 2 is shown in FIG. 3, at the bearing part 2B of the housing 2, an axial direction gas groove 13*b* that makes the diameter direction gas hole 13*a* communicate with the outer space is formed at the sliding part with the shaft part 3B.

A position of this axial direction gas groove 13*b* is formed at a position rotated along the bearing part 2B by 90 degrees with respect to the axial direction oil supply groove 11*c*, and thus, at the same time when the diameter direction oil supply hole 11*b* of the oil supply passage 11 communicates with the axial direction oil supply groove 11*c*, the diameter direction gas hole 13*a* communicates with the axial direction gas groove 13*b*.

When describing operations of the vane pump 1 having the above-described configuration hereinafter, similarly to a conventional vane pump 1, when the rotor 3 is rotated by actuation of the engine, the vane 4 also rotates reciprocating in the groove 9 of the rotor 3 along with the actuation, and a volume of a space of the pump chamber 2A partitioned by the vane 4 changes according to the rotation of the rotor 3.

As a result of it, a volume in the space of the intake air passage 6 side partitioned by the vane 4 increases to generate a negative pressure in the pump chamber 2A, and a gas is sucked from the servo unit through the intake air passage 6 to generate a negative pressure in the servo unit. The sucked gas is then compressed due to decrease of a volume of the space of the discharge passage 7 side, and it is discharged from the discharge passage 7.

Meanwhile, when the vane pump 1 is started, the lubricating oil is supplied to the oil supply passage 11 from the hydraulic pump driven by the engine through the oil supply pipe 12, and this lubricating oil flows into the pump chamber 2A when the diameter direction oil supply hole 11*b* and the axial direction oil supply groove 11*c* of the housing 2 communicate with each other by the rotation of the rotor 3.

The lubricating oil having flowed into the pump chamber 2A flows into the hollow part 3*a* of the rotor part 3A from the gap between the bottom surface 9*a* of the groove 9 part formed at the rotor part 3A and the vane 4, this lubricating oil spouts in the pump chamber 2A from the gap between the vane 4 and the groove 9, and from a gap between the vane 4 and the cover 5 to lubricate these gaps and to seal the pump chamber 2A, and after that, the lubricating oil is discharged from the discharge passage 7 along with the gas.

When the engine is stopped from the above-described operational state, the rotor 3 is stopped according to the engine stop, and air intake from the servo unit finishes.

Here, although the space of the intake air passage 6 side partitioned by the vane 4 remains still in a negative pressure state when the rotor 3 stops, if the opening of the diameter direction oil supply hole 11*b* and the axial direction oil supply groove 11*c* do not correspond to each other at this time, the lubricating oil in the axial direction oil supply hole 11*a* does not flow into the pump chamber 2A.

In contrast with this, when the rotor 3 stops in a state where the opening of the diameter direction oil supply hole 11*b* and the axial direction oil supply groove 11*c* correspond to each other, a large amount of lubricating oil in the oil supply passage 11 tends to flow into the pump chamber 2A due to the negative pressure of the pump chamber 2A.

However, when the opening of the diameter direction oil supply hole 11*b* and the axial direction oil supply groove 11*c* correspond to each other, the diameter direction gas hole 13*a* and the axial direction gas groove 13*b* simultaneously correspond to each other, and thus the atmosphere flows into the pump chamber 2A from this diameter direction gas hole 13*a* to eliminate the negative pressure therein, thereby enabling to prevent the large amount of lubricating oil from flowing into the pump chamber 2A.

Therefore, in the vane pump 1 having the above-described configuration, when a passage area of the gas passage 13 is defined as $S_1$, a passage area of the oil supply passage 11 is $S_2$, a passage area of the oil supply pipe 12 is $S_3$, a diameter of the diameter direction oil supply hole 11*b* is $d_2$, and a width of the axial direction oil supply groove in a rotational direction of the rotor 3 is L, the passage area $S_2$ of the oil supply passage is set to be in a range of $S_1<S_2\leqq 3\times S_1$, and the passage area $S_3$ of the oil supply pipe is $S_2<S_3 3\times S_2$, and further the width L of the axial direction oil supply groove is $d_2<L<4\times d_2$, whereby the air of the outer space is prevented from being sucked into the pump chamber 2A from the gas passage 13 as much as possible when a hydraulic pressure of the lubricating oil supplied from the hydraulic pump to the oil supply passage 11 is low.

The passage area $S_1$ of the gas passage 13 is set to be as small a passage area $S_1$ as possible in order to reduce the leakage of the lubricating oil to the outer space through the gas passage 13 when the hydraulic pressure of the lubricating oil supplied from the hydraulic pump to the oil supply passage 11 is high.

In a case of the embodiment, the passage area of the diameter direction gas hole 13*a* constituting the gas passage 13 is set as the passage area $S_1$, and passage areas of the other axial direction gas grooves 13*b* constituting the gas passage 13 are respectively set to be larger than the passage area $S_1$ of the diameter direction gas hole 13*a*.

Although this diameter direction gas hole 13*a* is preferably as small as possible, it is preferable to employ, for example, a hole with a diameter of 1.5 millimeters in a balance with processing technology or cost, and in this case, the passage area $S_1$ of the diameter direction gas hole 13*a* is 1.77 $mm^2$.

Next, in the embodiment, the passage area of the diameter direction oil supply hole 11*b* constituting the oil supply passage 11 is set as the passage area $S_2$, and passage areas of the other axial direction oil supply holes 11*a* and axial direction oil supply grooves 11*c* constituting the oil supply passage 11 are all set to be larger than the passage area $S_2$ of the diameter direction oil supply hole 11*b*.

It is preferable to employ, for example, a hole with the diameter $d_2$=2 millimeters to 2.5 millimeters as the diameter direction oil supply hole 11*b*, and in this case, the passage area $S_2$ of the diameter direction oil supply hole 11*b* is 3.14 to 4.91 $mm^2$. Namely, in this case, a passage area ratio of the diameter direction oil supply hole 11*b* and the diameter direction gas hole 13*a* is $S_2=1.8\times S_1$ to $2.8\times S_1$.

As described above, the passage area $S_2$ of the oil supply passage 11 is made to be a relatively small passage area within 3 times larger than the small passage area $S_1$ of the gas passage 13, thereby enabling to make it difficult to suck the air. Meanwhile, the passage area $S_2$ of the oil supply passage 11 is set to be larger than the passage area $S_1$ of the gas passage 13, and thereby a required lubricating oil is made to be reliably supplied in the pump chamber 2A.

Next, in the embodiment, the passage area $S_3$ of the oil supply pipe 12 is set to be larger than the passage area $S_2$ of the above-mentioned oil supply passage 11.

It is preferable to employ, for example, a hole with a diameter of 3.5 millimeters as a hole of the oil supply pipe 12, and in this case, the passage area $S_3$ of the oil supply pipe 12 is 9.62 $mm^2$. Namely, in the embodiment, a passage area ratio of the oil supply pipe 12 and the supply passage 11 falls in a range of $S_3=2.0\times S_2$ to $3\times S_2$.

As described above, if the passage area $S_3$ of the oil supply pipe 12 is set to be larger than the passage area $S_2$ of the oil supply passage 11, it can be expected to obtain a squeezing effect due to the oil supply passage 11, and thereby a hydraulic pressure in the oil supply passage 11 can be kept as high as possible even with a small amount of lubricating oil at the time of idling.

Further, in the embodiment, the width L of the axial direction oil supply groove 11*c* in the oil supply passage 11 is set in the range of $d_2<L<4\times d_2$. In a case of the embodiment, since the diameter of the diameter direction oil supply hole 11*b* is set to be in the range of $d_2$=2 millimeters to 2.5 millimeters, the width L of the axial direction oil supply groove 11*c* is larger than 2 millimeters, and falls in a range of less than 10 millimeters.

When the width L of the axial direction oil supply groove is set to be too large, an overlap time of the diameter direction oil supply hole 11*b* and the axial direction oil supply groove 11*c* becomes longer, and particularly when the hydraulic pressure of the oil supply passage at the time of idling is low, the air is easily sucked due to vacuum of the pump chamber, and thus the width L of the axial direction oil supply groove is set to be in the above-described range to thereby suppress suck of the air.

Figure 4:
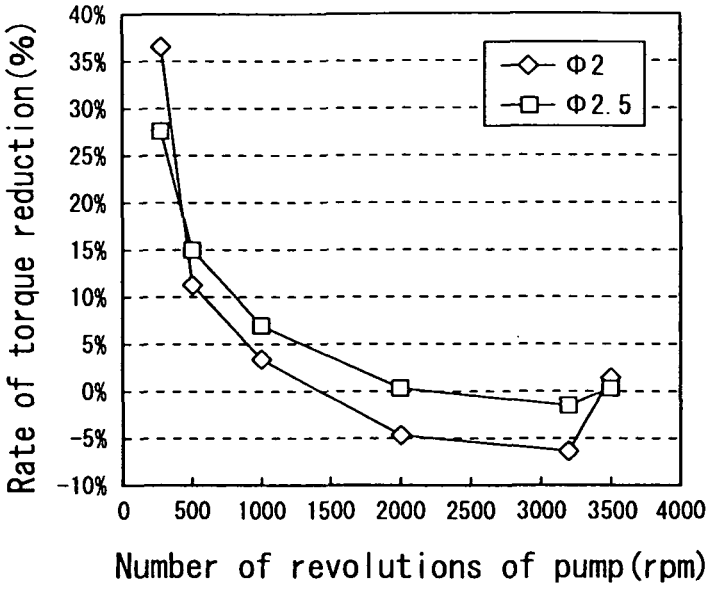
FIG. 4 is a test result graph obtained by testing a relation between the number of revolutions and driving torque.
Figure 5:
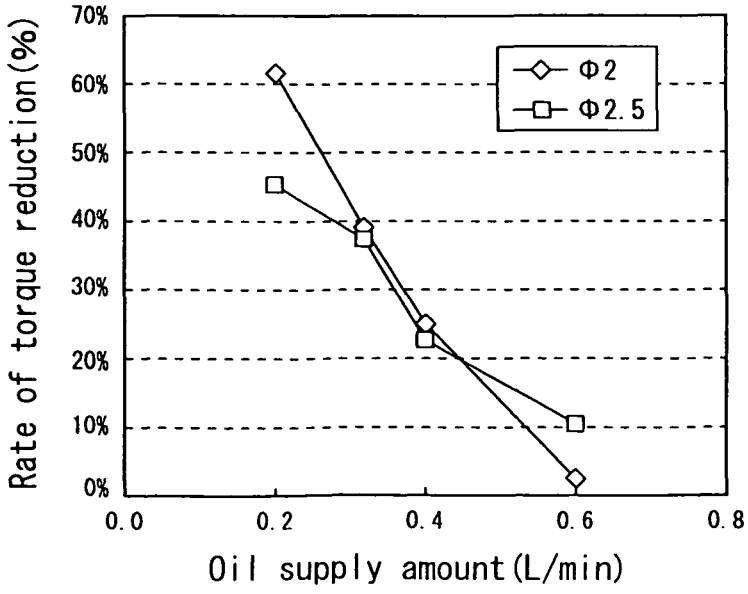
FIG. 5 is a test result graph obtained by testing a relation between an oil supply amount to a pump chamber 2A and driving torque.

FIGS. 4 and 5 are graphs showing test results, respectively. FIG. 4 is a test result graph obtained by testing a relation between the number of revolutions and driving torque, and it shows as a rate of torque reduction (%) how much driving torque of the exemplary vane pump of the present invention fluctuated with respect to amplitude of driving torque in a conventional example.

In addition, FIG. 5 is a test result graph obtained by testing a relation between an oil supply amount to the pump chamber 2A and driving torque, and similarly to the case of FIG. 4, it shows as the rate of torque reduction (%) how much driving torque of the exemplary vane pump of the present invention fluctuated with respect to a test result of the conventional example.

In the test of FIG. 4, a supply pressure of a lubricating oil is adjusted so that an oil supply amount may be 0.3 to 0.4 L/m at each number of revolutions, and in the test of FIG. 5, the supply pressure of the lubricating oil is adjusted so that a supply amount shown in FIG. 5 can be obtained while keeping the number of revolutions of the pump substantially constant (approximately 300 rpm).

◇ marks and □ marks in FIGS. 4 and 5 indicate the example of the present invention, the diameter $d_2$ of the diameter direction oil supply hole 11*b* is set to be 2 millimeters (passage area $S_2$=3.14 $mm^2$) in the ◇ marks, and the diameter $d_2$ is 2.5 millimeters (passage area $S_2$=4.91 $mm^2$) in the □ marks. In addition, the diameter of the diameter direction oil supply hole of the conventional example is set to be 3 millimeters (passage area $S_2$=7.07 $mm^2$).

Further, a diameter of the diameter direction gas hole 13*a* is set to be 1.5 millimeters in each drawing (including the conventional example), and thus the passage area $S_1$ of the gas passage 13 is set to be 1.77 $mm^2$. In addition, a hole of 3.5 millimeters is employed for the passage area $S_3$ of the oil supply pipe 12, thus the passage area $S_3$ of the oil supply pipe 12 is set to be 9.62 $mm^2$, and further, the width L of the axial direction oil supply groove 11*c* in the oil supply passage 11 is 7.5 millimeters.

As can be understood from the test results shown in FIG. 4, when the diameter of the diameter direction gas hole 13*a* is made smaller to thereby make the passage area $S_2$ of the oil supply passage 11 smaller as in the examples of the present invention (◇ and □), a large rate of torque reduction can be expected particularly in a low revolution region of approximately 500 rpm as compared with the conventional example with the large passage area $S_2$ of the oil supply passage 11.

This shows that in the conventional example with the large passage area $S_2$ of the oil supply passage 11, an amount of air sucked into the pump chamber 2A increases as the number of revolutions of the pump becomes not more than 500 revolutions, the air sucked along with the rotation of the vane 4 is again discharged to an outside of the pump chamber 2A, and therefore, driving torque becomes larger along with the increase of the amount of air sucked into the pump chamber 2A, while according to the example of the present invention, the amount of air sucked into the pump chamber 2A can be reduced.

In addition, it can be understood from the test results shown in FIG. 5 that according to the example of the present invention (◇ and □), a larger rate of torque reduction can be expected as compared with the conventional example particularly in a region of 0.2 to 0.4 L/m with a small oil supply amount.

Note that it goes without saying that although the above-described each embodiment has been described using the vane pump 1 including a sheet of vane 4, the conventionally known vane pump 1 including a plurality of vanes 4 is also applicable, and additionally, an application of the vane pump 1 is not limited to generate a negative pressure in a servo unit.

REFERENCE SIGNS LIST

1 Vane pump
2 Housing
2A Pump chamber
2B Bearing part
3 Rotor
3A Rotor part
3B Shaft part
4 Vane
11 Oil supply passage
11*a* Axial direction oil supply hole
11*b* Diameter direction oil supply hole
11*c* Axial direction oil supply groove
12 Oil supply pipe
13 Gas passage
13*a* Diameter direction gas hole
13*b* Axial direction gas groove

The invention claimed is:

1. A vane pump comprising: a housing comprising a substantially circular pump chamber; a rotor that rotates about a position eccentric with respect to a center of the pump chamber; a vane that is rotated by the rotor and that always partitions the pump chamber into a plurality of spaces; an oil supply passage that intermittently communicates with the pump chamber by the rotation of the rotor; an oil supply pipe that is connected to the oil supply passage to supply a lubricating oil from a hydraulic pump thereto; and a gas passage that makes the pump chamber and an outer space communicate with each other when the oil supply passage communicates with the pump chamber by the rotation of the rotor, wherein the oil supply passage comprises a diameter direction oil supply hole provided at a shaft part of the rotor in a diameter direction thereof; and an axial direction oil supply groove that is provided in the housing to communicate with the pump chamber, and with which an opening of the diameter direction oil supply hole is made to intermittently overlappingly communicate by the rotation of the rotor, and the gas passage comprises a diameter direction gas hole that is provided at the shaft part of the rotor in the diameter direction thereof to communicate with the oil supply passage; and an axial direction gas groove that is provided in the housing to communicate with the outer space, and with which an opening of the diameter direction gas hole is made to intermittently overlappingly communicate by the rotation of the rotor, and the diameter direction gas hole is made to communicate with the axial direction gas groove when the diameter direction oil supply hole is made to communicate with the axial direction oil supply groove, when a passage area of the gas passage is defined as $S_1$, a passage area of the oil supply passage is $S_2$, a passage area of the oil supply pipe is $S_3$, a diameter of the diameter direction oil supply hole is $d_2$, and a width of the axial direction oil supply groove in a rotational direction of the rotor is L, the passage area $S_2$ of the oil supply passage is set to be greater than the passage area $S_1$ of the gas passage, and not greater than three times the passage area $S_2$ such that a required lubricating oil is made to be reliably supplied in the pump chamber via the oil supply passage, the passage area $S_3$ of the oil supply pipe is set to be greater than the passage area $S_2$ of the oil supply passage, and in a range between two and three times the passage area of $S_2$, inclusive such that a hydraulic pressure of the oil supply passage is kept high due to a squeezing effect, and the width L of the axial direction oil supply groove is set to be greater than the diameter of the diameter direction oil supply hole $d_2$ to suppress sucking of the air in the pump chamber when a hydraulic pressure of the oil supply passage is low.

2. The vane pump according to claim 1, wherein the oil supply passage is provided inside the rotor in an axial direction thereof, and comprises an axial direction oil supply hole communicating with the oil supply pipe, and the diameter direction oil supply hole communicates with the axial direction oil supply hole.

3. The vane pump according to claim 2, wherein the diameter direction gas hole communicates with the axial direction oil supply hole.

4. The vane pump according to claim 1, wherein the passage area $S_1$ is 1.77 $mm^2$, the passage area $S_2$ is from 3.14 to 4.91 $mm^2$, the passage area $S_3$ is 9.62 $mm^2$, the diameter $d_2$ is from 2 to 2.5 mm and the width L is from 2 up to less than 10 mm.

* * * * *